US008032063B2

(12) United States Patent
Sheen

(10) Patent No.: US 8,032,063 B2
(45) Date of Patent: Oct. 4, 2011

(54) DEVELOPING DEVICE AND IMAGE FORMING APPARATUS WITH THE SAME

(75) Inventor: So Won Sheen, Seoul (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 260 days.

(21) Appl. No.: 12/270,459

(22) Filed: Nov. 13, 2008

(65) Prior Publication Data

US 2009/0175659 A1 Jul. 9, 2009

(30) Foreign Application Priority Data

Jan. 7, 2008 (KR) ..... 10-2008-0001538

(51) Int. Cl.
*G03G 15/08* (2006.01)

(52) U.S. Cl. ..... 399/254; 399/256

(58) Field of Classification Search ..... 399/254, 399/256, 252

See application file for complete search history.

(56) References Cited

U.S. PATENT DOCUMENTS 5,529,628 A * 6/1996 Fuchiwaki et al.
5,550,619 A * 8/1996 Komakine et al.
2007/0122202 A1* 5/2007 Taguma et al. ..... 399/254

FOREIGN PATENT DOCUMENTS

JP 06-51634 2/1994
JP 2002-14527 1/2002
JP 2002328530 A * 11/2002

OTHER PUBLICATIONS

Machine English language translation of JP 2002-14527, published Jan. 18, 2002.
Machine English language translation of JP 06-51634, published Feb. 25, 1994.

* cited by examiner

*Primary Examiner* — Susan Lee
(74) *Attorney, Agent, or Firm* — Stanzione & Kim, LLP

(57) ABSTRACT

An image forming apparatus includes a photosensitive member and a developing device. The developing device includes a developing roller to supply a developer to the photosensitive member and a casing defining an external appearance of the developing device. A first auger section is defined in the casing to agitate and convey the developer, and a second auger section is defined in the casing and divided from the first auger section. A developer delivery unit is provided on the outside of the casing to deliver the developer from the first auger section to the second auger section.

28 Claims, 7 Drawing Sheets

DEVELOPING DEVICE AND IMAGE FORMING APPARATUS WITH THE SAME

CROSS-REFERENCE TO RELATED APPLICATION

This application claims the benefit of Korean Patent Application No. 2008-0001538, filed on Jan. 7, 2008 in the Korean Intellectual Property Office, the disclosure of which is incorporated herein by reference.

BACKGROUND OF THE INVENTION

1. Field of the Invention

The present invention relates to a developing device and an image forming apparatus with the same, and, more particularly, to delivery of developer in a developing device, and an image forming apparatus with the same.

2. Description of the Related Art

Of conventional electro-photographic image forming apparatuses such as, e.g., copiers, facsimiles, printers, or multi-functional print devices, or the like, the most widely used examples of developer include, e.g., a binary developing type, which uses a binary developer composed of toner and magnetic carriers, and a hybrid developing type, in which a binary developer composed of nonmagnetic toner and magnetic carrier is used, in both of which types the charged toner is carried by a developing roller, and is applied to an electrostatic latent image so as to develop the electrostatic latent image.

In such binary developing type image forming apparatus, for example, after an outer circumferential surface of a photosensitive drum (i.e. latent image carrier) is uniformly charged, the photosensitive drum is subjected to an exposure process using, e.g., a laser scanning unit, etc., to form an electrostatic latent image thereon representative of an image to be recorded. The toner, magnetized via a carrier and adhering to an outer circumferential surface of a developing sleeve (i.e. developer retainer) of a developing device, is supplied to the photosensitive drum via the rotation of the developing sleeve, to develop the electrostatic latent image. The resulting toner image is transferred, and is fixed by heat and/or pressure, to a recording medium, such as for example, a sheet of paper, thus completing the recording of the image.

An example of the developing device included in the above-described image forming apparatus is disclosed in Japanese Patent Laid-Open Publication No. JP-H06-051634 to Shintaro et al. ("Shintaro").

Shintaro discloses a developing device that includes a developing roller installed to oppose an electrostatic latent image retainer, on which an electrostatic latent image is formed as charge potential differences. The developing roller is provided in the housing of the developing device, in which the binary developer composed of nonmagnetic toner and magnetic carrier is stored, and receives an amount of the developer magnetically adhering on the surface of the developing roller such that a magnetic brush is formed. The disclosed developing device further includes a developer regulating member to regulate the amount of the developer adhering to the developing roller, a first agitating chamber having a first auger to convey the developer along the rotational axis direction of the developing roller, and a second agitating chamber separated vertically from the first agitating chamber by a partition so as to be located below the first agitating chamber, the second agitating chamber having a second auger.

In a developing device having the above-described configuration, the developer moves upward from the second agitating chamber to the first agitating chamber via operation of the first and second augers, and then, is supplied from the first agitating chamber to the developing roller. The extraneous remaining developer after development is conveyed from the developing roller back to the second agitating chamber. This circulation of the developer may prevent possible deterioration of the developer, which can result from the developer remaining stationary in the first agitating chamber.

However, since the developer in the second agitating chamber is pushed upward to the first agitating chamber through a passage defined in a corner of the second agitating chamber, the developer in the passage may be subjected to a high pressure, causing deterioration of the developer.

Another example of the developing device is disclosed in Japanese Patent Laid-Open Publication No. JP 2002-014527 to Akihiro et al. ("Akihiro"). Akihiro discloses a developing device that includes a developing roller installed to oppose an electrostatic latent image retainer, and to which developer magnetically adheres, a first agitator disposed near the developing roller to agitate and convey the developer, a second agitator, which is installed below the first agitator, and which is adapted to receive the developer at a downstream end of the first agitator in a developer conveyance direction so as to agitate and supply the developer to the developing roller, and a developer elevator, which is installed at the center of vertical direction between the first agitator and the second agitator, and which is adapted to receive the developer at a downstream end of the second agitator in the developer conveyance direction so as to supply the developer to the second agitator.

The above-described developing device of Akihiro may have the effect of preventing deterioration of the developer due to the high pressure applied to the developer resulting in developing devices such as the above-described example of Shintaro by allowing the developer elevator to carry the developer magnetically adhered to the outer circumferential surface thereof to supply the developer directly from the first agitator to the second agitator. However, this necessitates a seal to prevent leakage of the developer from the developer elevator.

The developer elevator requires a complex magnet arrangement to allow the first agitator to have the developer to adhere thereto and the second agitator to release the developer, and also requires a sleeve to encase the magnet, and to form the outer circumferential surface, adding complexity and cost in manufacturing.

BRIEF DESCRIPTION OF THE DRAWINGS

Various aspects and advantages of the embodiments of the invention will become apparent and more readily appreciated from the following description of the embodiments, taken in conjunction with the accompanying drawings, of which.

DETAILED DESCRIPTION OF THE PREFERRED EMBODIMENTS

Figure 1:
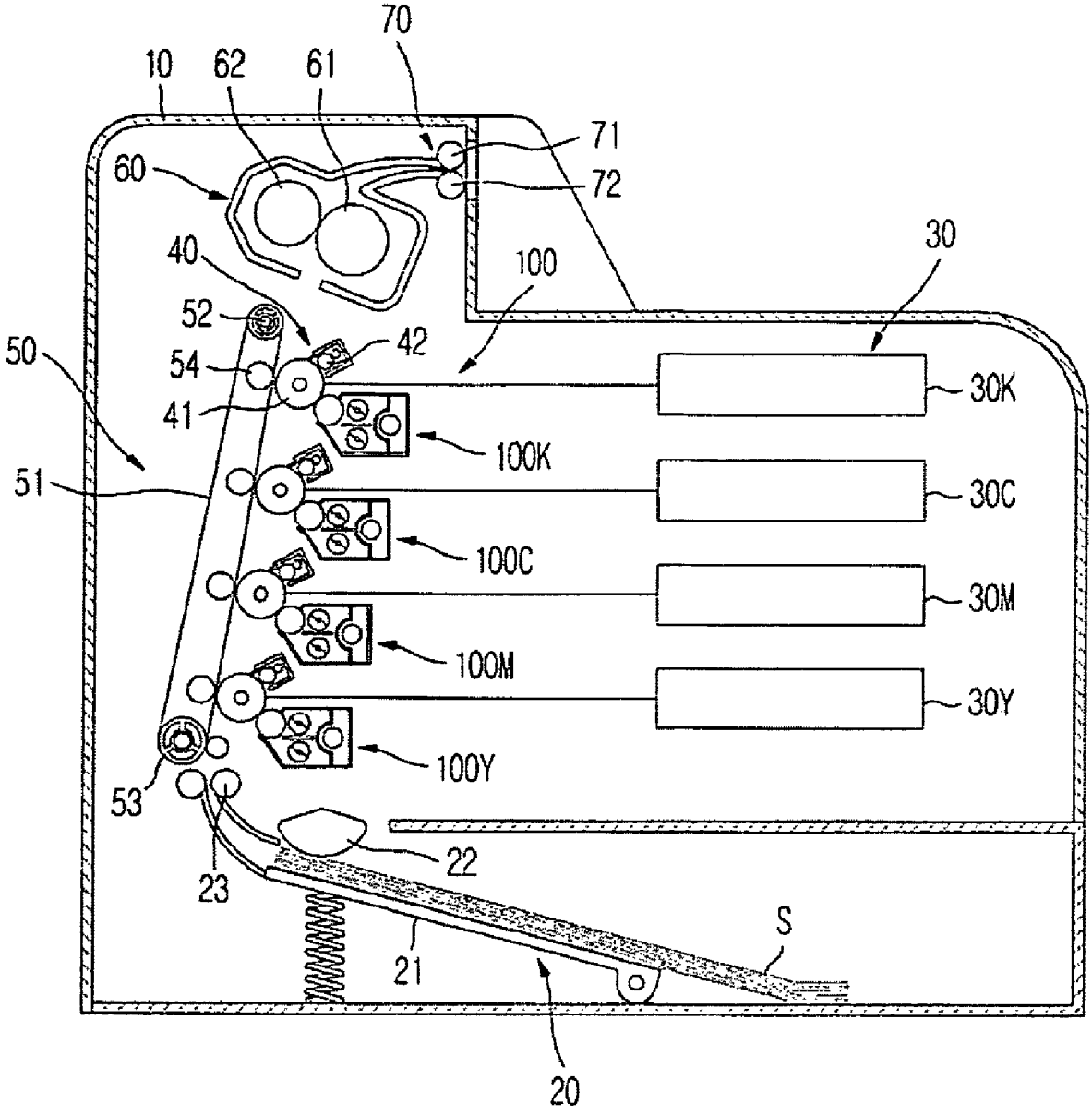
FIG. 1 is a sectional view illustrating the configuration of an image forming apparatus in accordance with an embodiment of the present invention.

Reference will now be made in detail to exemplary embodiments of the present invention, examples of which are illustrated in the accompanying drawings, wherein like reference numerals refer to like elements throughout. While the embodiments are described with detailed construction and elements to assist in a comprehensive understanding of the various applications and advantages of the embodiments, it should be apparent however that the embodiments can be carried out without those specifically detailed particulars. Also, well-known functions or constructions will not be described in detail so as to avoid obscuring the description with unnecessary detail.

FIG. 1 is a sectional view illustrating the configuration of an image forming apparatus in accordance with an embodiment of the present invention.

The embodiment relates to an electro-photographic image forming apparatus, including such as for example, a copier, facsimile, black/white or color printer, or the like, and a developing device, which is usable in such image forming apparatus, and which uses, e.g., a binary developer composed of nonmagnetic toner and magnetic carrier.

As shown in FIG. 1, an image forming apparatus in accordance with an embodiment may include a body 10, a paper supply device 20, an exposure device 30, a photosensitive device 40, a developing device 100, a transfer device 50, a fixing device 60, and a paper discharge device 70.

The body 1 defines an external appearance of the image forming apparatus, and supports a variety of elements installed therein.

The paper supply device 20 serves to supply paper S as a printing medium. The paper supply device 20 may include a paper supply tray 21 in which the paper S is loaded, and a pickup roller 22 to pick up the paper S loaded in the paper supply tray 21 sheet by sheet. The paper S picked up by the pickup roller 22 is delivered to the developing device 100 by a delivery roller 23.

According to an embodiment, and to enable color images, the developing device 100 may include four developing units 100Y, 100M, 100C, and 100K, which receive different colors of toners, for example, yellow toner Y, magenta toner M, cyan toner C, and black toner K, respectively. The developing device 100 may alternatively have a single or any other number of developing units depending on the particular color image capability desired. A more detailed configuration of the developing device 100 will be described later.

The photosensitive device 40 may include four photosensitive units 40Y, 40M, 40C, and 40K, each of which photosensitive units including a photosensitive member 41 having a surface on which an electrostatic latent image is formed when the exposure device 30 irradiates light corresponding to the image information to the photosensitive member 41, and a charge roller 42 to charge the surface of the photosensitive member 41 to a predetermined potential.

The exposure device 30 includes four exposure units 30Y, 30M, 30C, and 30K to irradiate light to the photosensitive members 41 of the respective photosensitive units 40Y, 40M, 40C, and 40K according to the image being printed, the irradiated light from each of the exposure units 30Y, 30M, 30C, and 30K corresponding to image information of yellow, magenta, cyan, and black, respectively, to form the electrostatic latent images on the surfaces of the respective photosensitive members 41.

The transfer device 50 serves to transfer a toner image developed on each photosensitive member 41 to the paper. The transfer device 50 may include a circulating transfer belt 51 in contact with the respective photosensitive members 41, a drive roller 52 to drive the transfer belt 51, a tension roller 53 to maintain a predetermined tension of the transfer belt 51, and four transfer rollers 54 to transfer the toner image developed on each photosensitive member 41 to the paper S.

While as an illustrative example of a color image forming apparatus, in the above description, four units corresponding to the four primary colors are provided for each of the exposure device 30, the photosensitive device 40, the developing device 100, and for the transfer device 50, it should be apparent to those skilled in the art that the application of the present embodiment is not limited to any particular number of these units, and that in fact, any number of these units are possible in different or alternative applications.

The fixing device 60 serves to fix the image transferred to the paper by applying heat and pressure. The fixing device 60 may include a heating roller 61 having a heating source to apply heat to the paper on which the toner image was transferred, and a pressure roller 62 to be pressed against the heating roller 61 with a predetermined pressure.

The paper discharge device 70 serves to discharge the paper, on which the image is completely printed, to the outside of the body 10. The paper discharge device 70 includes a paper discharge roller 71, and a paper backup roller 72 opposing the paper discharge roller 71.

In an image forming apparatus having the above-described configuration, when a printing operation is to be carried out, a high voltage is applied to the charge rollers 42, allowing the surfaces of the photosensitive members 40 to be charged to a predetermined potential. The four exposure units 30Y, 30M, 30C, and 30K irradiate light representative of the image in each of the colors, yellow, magenta, cyan, and black, respectively, to the photosensitive members 41 of the respective developing units 40Y, 40M, 40C, and 40K. With the irradiation of light, electrostatic latent images are formed on the surfaces of the respective photosensitive members 41. Toner in the respective developing units 40Y, 40M, 40C, and 40K are supplied to developing rollers 120 (that will be later described in more detail) so as to be attached to the electrostatic latent images formed on the photosensitive members 41 via operation of the developing rollers 120. Thereby, yellow, magenta, cyan, and black toner images are formed on the respective photosensitive members 41.

After being picked up by the pick up roller 22 from the paper supply tray 21, the picked-up paper S is carried on the transfer belt 51, and is delivered by the transfer belt 51 to the developing device 100. As the paper S sequentially passes between the respective photosensitive members 41 and the transfer rollers 54 via operation of the transfer belt 51, the yellow, magenta, cyan, and black toner images developed on the respective photosensitive members 41 are transferred onto the paper such that they overlap one another, thereby forming a color image.

The toner images transferred to the paper are fixed to the paper while passing through the fixing device 60, and finally, the paper is discharged out of the body 10 via the paper discharge device 70.

Figure 2:
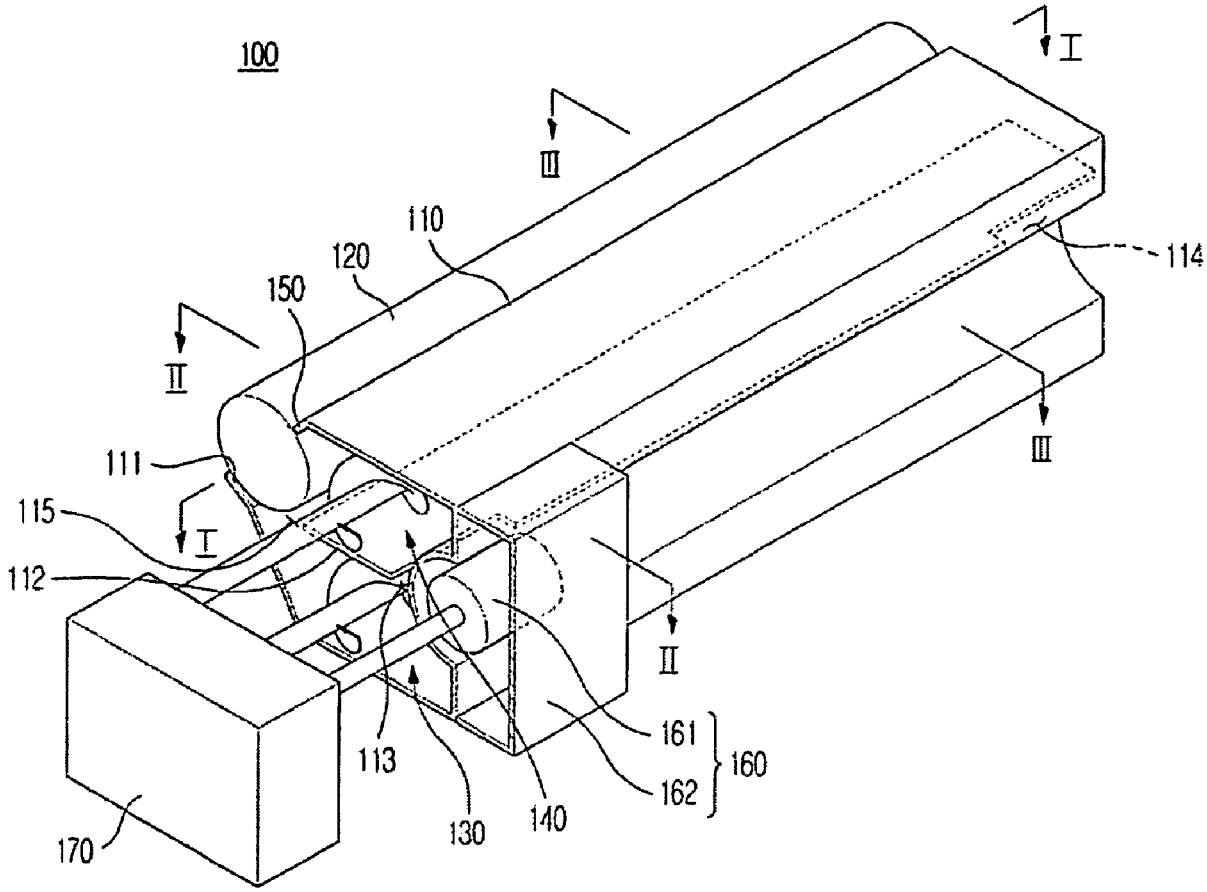
FIG. 2 is a partially cut-away perspective view illustrating developing device in accordance with a first embodiment of the present invention.
Figure 3:
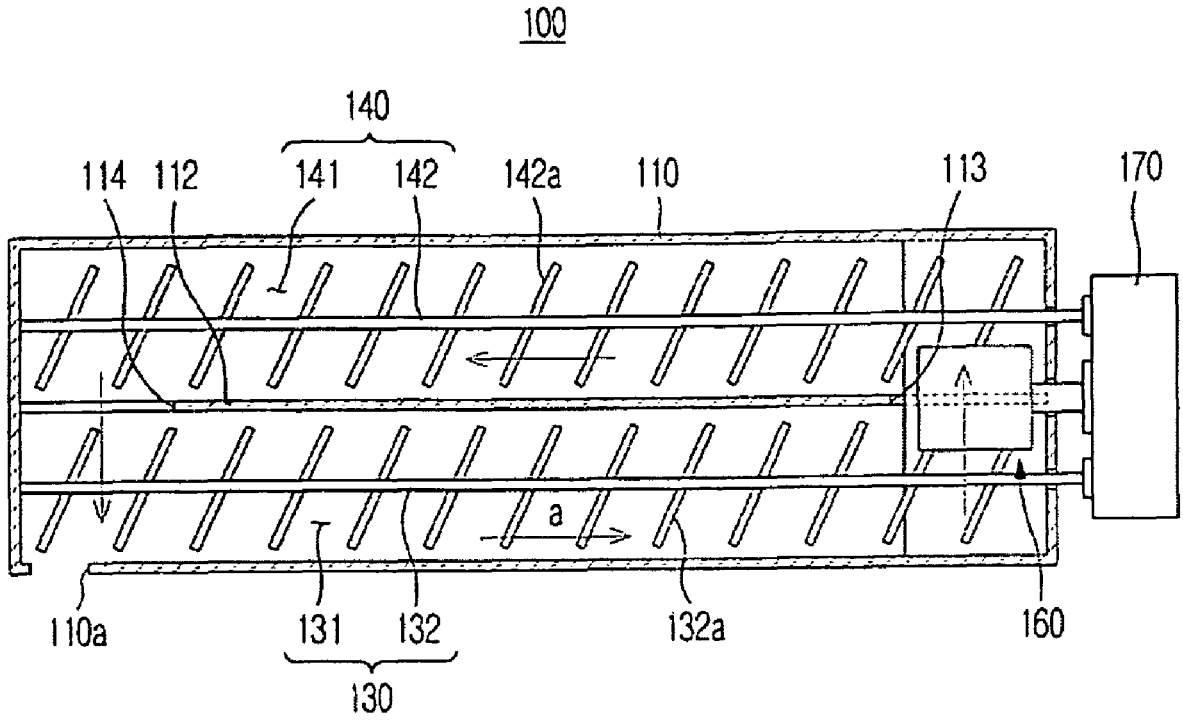
FIG. 3 is a sectional view taken along the arrows I-I of FIG. 2.
Figure 4:
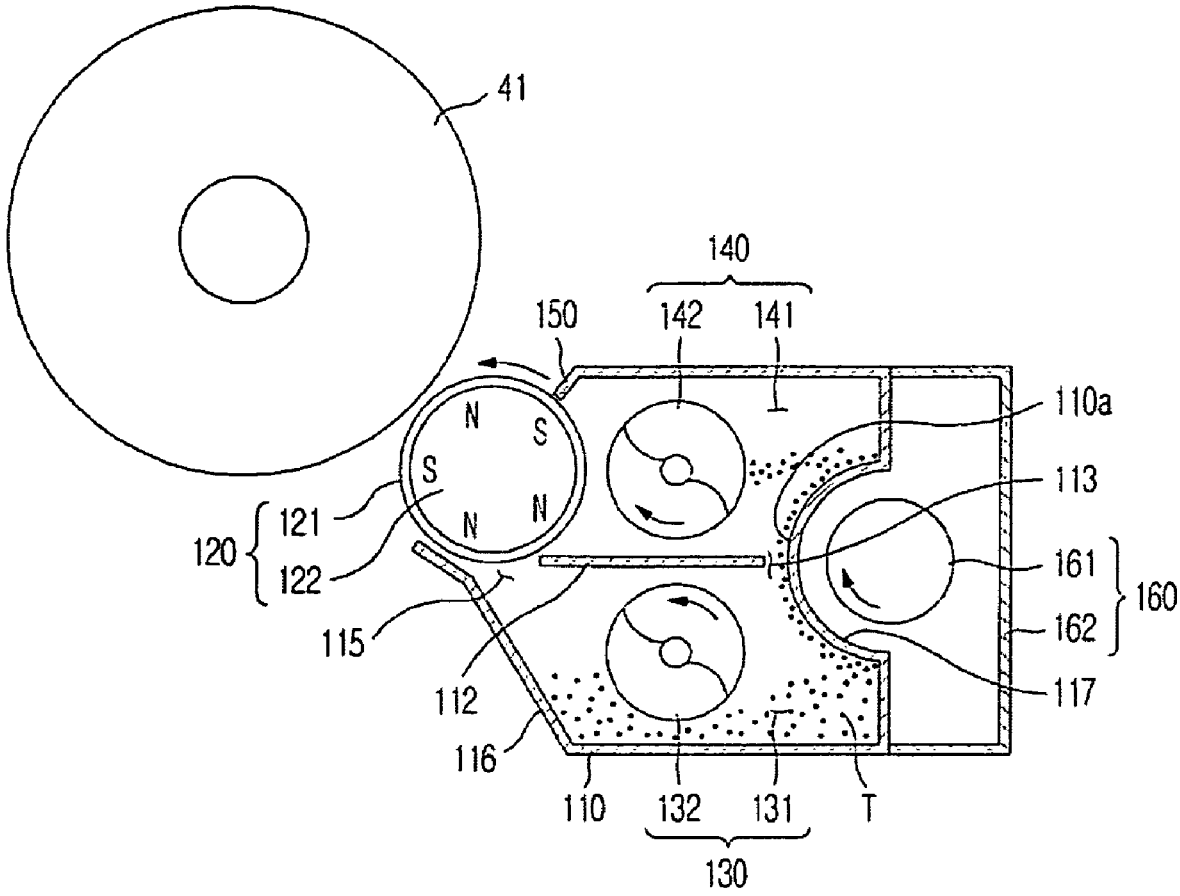
FIG. 4 is a sectional view taken along the arrows II-II of FIG. 2.
Figure 5:
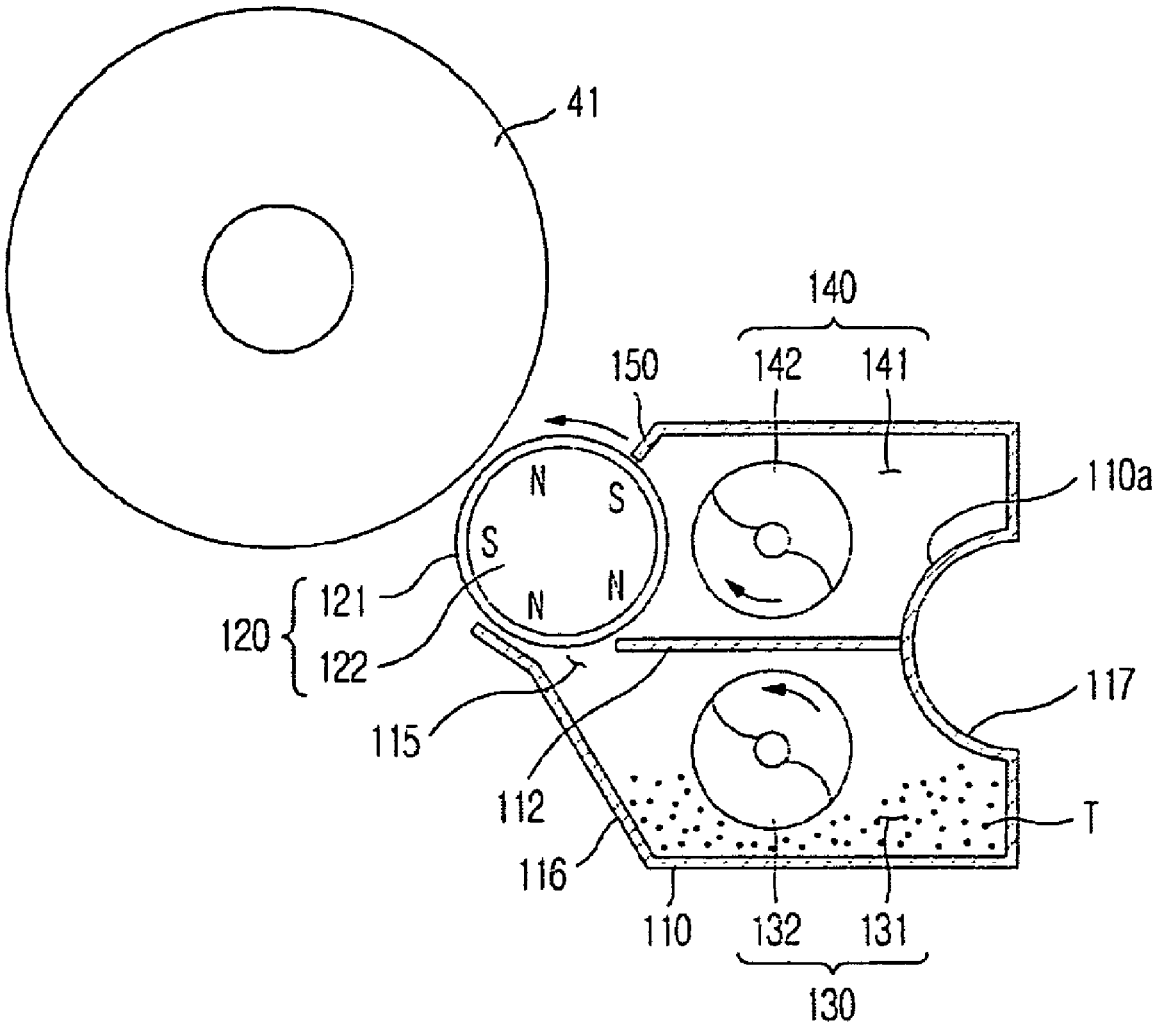
FIG. 5 is a sectional view taken along the arrows III-III of FIG. 2.

FIG. 2 is a partially cut-away perspective view illustrating a developing device in accordance with a first embodiment of the present invention. Each of FIGS. 3, 4 and 5 is a sectional view taken along the arrows I-I, II-II and III-III of FIG. 2, respectively. The developing device 100, for example, may receive a developer T composed of toner powder having an average particle diameter of, e.g., 7 μm, and carrier having an average particle diameter of, e.g., 55 μm, to supply the developer T to the photosensitive members 41. The developing device 100 according to the present embodiment is composed of four developing units 100K, 100C, 100M, and 100Y. As each of these four developing units 100K, 100C, 100M, and 100Y have the same configurations and operations as the other ones, it suffice to describe one of the developing units, referring as the developing device 100.

As shown in FIGS. 2 and 3, the developing device 100 includes a casing 110 to receive the developer T therein, the casing 110 defining an external appearance of the developing device 100, and being formed with an opening 111 extending in a longitudinal direction thereof. The developing device 100 further includes the developing roller 120 installed in the opening 111 to rotate about an axis parallel to the direction along which the opening 111 extends, the developing roller 120 serving to supply the developer T in the casing 110 to the associated photosensitive member 41. The developing device 100 also includes a first and second auger sections 130 and 140 defined on top of one another within the casing 110 to allow the developer F received in the casing 110 to be agitated and delivered, a regulator 150 protruding inward from an end of the casing 110 such that it is spaced apart from an outer circumferential surface of the developing roller 120 by a predetermined distance to regulate the amount of developer T adhering to the surface of the developing roller 120, and a developer delivery unit 160 to deliver the developer T from the first auger section 130 to the second auger section 140.

The casing 110 serves as a developer container, in which to accommodate the developer T to be supplied to the photosensitive member 41, and to which the developer T is recovered from the photosensitive member 41. The interior of the casing 110 is divided into the lower first auger section 130 and the upper second auger section 140 by a partition 112.

The partition 112 is provided at both ends thereof with first and second communicating holes 113 and 114 each having a predetermined width. The first and second communicating holes 113 and 114 serve as passages between the first and second auger sections 130 and 140, to deliver the developer T from the first auger section 130 to the second auger section 140 or vice versa.

The casing 110 is further formed with a third communicating hole 115 through which the first and second auger sections 130 and 140 communicate with each other, the third communicating hole 115 having a length corresponds substantially to that of the developing roller 120. Through the third communicating hole 115, the developer T can be supplied from the second auger section 140 to the developing roller 120, and some of the supplied developer T can be conveyed back into the first auger section 130. This supply and conveyance of the developer T allows the developer T that had been supplied to the developing roller 120 to be sufficiently agitated with new developer r, and reduces deterioration of the developer T.

In this case, a sidewall 116 of the first auger section 130 is inclined to guide developer T, which had been supplied from the second auger section 140 to the developing roller 120, to be returned into the first auger section 130 through the third communicating hole 115.

The first auger section 130 includes a first receiving space 131 to receive the developer therein, and a first auger screw 132 to agitate and deliver the developer T received in the first receiving space 131. The second auger section 140 includes a second receiving space 141 to receive the developer T therein, and a second auger screw 142 to agitate and deliver the developer T received in the second receiving space 141.

The first and second auger screws 132 and 142 each respectively includes spiral agitating blades 132*a* and 142*a* arranged along, and rotating about, the respective axis parallel to the axis of the developing sleeve 121. The pair of auger screws 132 and 142 having the above-described configuration each delivers the developer T in opposite axial direction with respect to each other.

Of the first and second auger sections 130 and 140 divided by the partition 112, the developer T received in the lower first auger section 130, as shown in FIG. 3, is delivered in a direction designated by the arrows a via the operation of the first auger screw 132. The delivered developer T is further delivered into the upper second auger section 140 through the first communicating hole 113. The developer T in the second auger section 140 is agitated and delivered via the operation of the second auger screw 142 such that a part of the developer T is conveyed to the developing roller 120, some of which being conveyed back into the first auger section 130 through the third communicating hole 115 (See FIG. 5), and the remaining developer T is delivered un the axial direction, and into the first auger section 130 through the second communicating hole 114. That is, the developer T in the first auger section 130 is delivered to the second auger section 140 through the first communicating hole 113, and the developer T delivered to the second auger section 140 falls into the first auger section 130 through the second communicating hole 114, resulting in one-directional circulation (in a direction designated by the arrows a) of the developer T.

According to an embodiment, the first auger section 130 may include a developer supply hole 110*b* to receive the developer T. A developer storage container (not shown) is connected to the developer supply hole 110*b* through which supplemental developer T may be supplied.

The regulator 150 has its distal end with respect to the casing 110 protruding toward the opening 111 of the casing 110 to face the outer circumferential surface of the developing sleeve 121 at a predetermined distance.

The developing roller 120 includes the cylindrical developing sleeve 121 rotatably installed at least partially in the opening 111 of the casing 110 such that portions of the outer circumferential surface of the developing sleeve 121 successively face the opening 111 according to rotation of the developing roller 120, and a magnetic-field generator 122 having a plurality of magnets provided inside the developing sleeve 121 to generate a magnetic field around the outer circumferential surface of the rotating developing sleeve 121.

The developing sleeve 121 may be made of a nonmagnetic substance, such as, e.g., aluminum, and serves to supply the developer T to the photosensitive member 41 and to collect the unused developer T from the photosensitive member 41 using the magnetic field generated by the magnetic-field generator 122.

The magnetic-field generator 122 may take the form of a multi-polar magnet composed of a plurality of magnets (in the present embodiment, for example, five magnets) circumferentially arranged with a predetermined interval, and each magnet is installed to generate a magnetic force line in a normal direction of the developing sleeve 121. The plurality of magnets are appropriately arranged to allow the developer T to be received from the second auger section 140, and to allow the developer T supplied to the photosensitive member 41 to be separated above the third communicating hole 115.

The magnet arrangement of the magnetic-field generator 122 is known in the field of the present invention, the detailed description of which is thus unnecessary.

The developing device 100 further includes a developer delivery unit 160 to deliver the developer T from the first auger section 130 to the second auger section 140.

The developer delivery unit 160, as shown in FIGS. 2 and 4, is disposed external to the casing 110 at a location proximate to the first communicating hole 113. The developer delivery unit 160 may include a magnet 161 to deliver the developer T, a driver 170 to drive the magnet 161, and a cover 162 to cover the magnet 161.

The magnet 161 takes the form of a roller having a length corresponding to the width of the first communicating hole 113. One side of the magnet 161 is connected to the driver 170 and the other side of the magnet 161 is rotatably coupled to the cover 162.

The casing 110 is provided with an arched seating portion 117 corresponding to the cylindrical shape of the magnet 161. An outer circumferential surface of the magnet 161 and an outer surface of the seating portion 117 of the casing 110 are spaced apart from each other by a predetermined distance, to apply a magnetic force of the magnet 161 to the developer T in the first auger section 130.

To adjust the magnetic force acting on the developer T for assuring smooth adherence and separation of the developer T, the shape and curvature of the seating portion 117 and/or the magnet 161, the distance between the magnet 161 and the seating portion 117, or the like may be empirically adjusted for as desired for the particular design and/or application of the developing device.

As shown in FIG. 4, the developer T in the first auger section 130 adheres to an inner surface 110*a* of the casing 110 adjacent to the magnet 161 by the magnetic force of the magnet 161. As the magnet 161 rotates, the developer T moves upward along the inner surface 110*a* of the casing 110, so as to be delivered to the second auger section 140 through the first communicating hole 113.

If the developer T, delivered into the second auger section 140, continuously moves upward along the inner surface 110*a* of the casing 110, and, when it becomes sufficiently far away from the magnet 161, the developer T is separated from the inner surface 110*a* of the casing 110 by a weight thereof, thereby being seated in the second auger section 140.

According to an embodiment, to lower the cost, the magnet 161 may have a uni-polar outer circumferential surface, which may be any one of N-pole and S-pole.

Alternatively, the magnet 161 may have a multi-polar outer circumferential surface similar to the magnetic-field generator 122. In the case, preferably, N-pole and S-pole are alternately formed on the outer circumferential surface of the magnet 161.

With the above-described configuration, since the developer delivery unit 160 is disposed outside the casing 110, the developer T can be delivered using the magnetic force of the rotating magnet 161 without requiring the developer T to directly adhere to or contact with the magnet 161, and can thus remain within the casing 110. Accordingly, it is not necessary to provide a seal for the developer delivery unit 160. For example, it is not necessary to provide a seal in the area of the cover 162 in which the driver 170 couples with the magnet 161.

Further, according to an embodiment, the developer T can be separated from the surface 110*a* by its own weight, allowing the developer delivery unit 160 to be constructed using a uni-polar simple magnet 161 without requiring complex magnet arrangement.

The driver 170 serves to provide a drive force required to rotate the magnet 161. Although a dedicated driver for the developer delivery unit 160 can be provided, according to an embodiment, the first and second auger screws 132 and 142 and the magnet 161 may be operated using a single driver as shown in FIG. 2. The single driver 170 may include one or more gears (not shown) to deliver the rotational force to the magnet 161 at an appropriate rotational velocity.

The developer delivery operation of the developing device having the above-described configuration will now be described with reference to the accompanying drawings.

The developer T, supplied into the first auger section 130 through the developer supply hole 110*b*, is agitated and delivered to the developer delivery unit 160 by the operation of the first auger screw 132.

The developer T, delivered to the developer delivery unit 160, adheres to the inner surface 110*a* of the seating portion 117 of the casing 110 by the magnetic force of the magnet 161. Then, the developer T moves upward along the inner surface 110*a* of the casing 110 via rotation of the magnet 161, thereby being delivered to the second auger section 140 through the first communicating hole 113.

If the developer T delivered to the second auger section 140 moves further upward along the inner surface 110*a* and away from the magnet 161, the developer T separates from the inner surface 110*a* of the casing 110 by its own weight, and is thereby seated in the second auger section 140.

While being agitated and delivered by operation of the second auger screw 142, a part of the developer T is supplied to the developing roller 120, some of which is re-collected into the first auger section 130 through the third communicating hole 115, while the remaining quantity of developer T is delivered in the axial direction t, and to the first auger section 130 through the second communicating hole 114.

Figure 6:
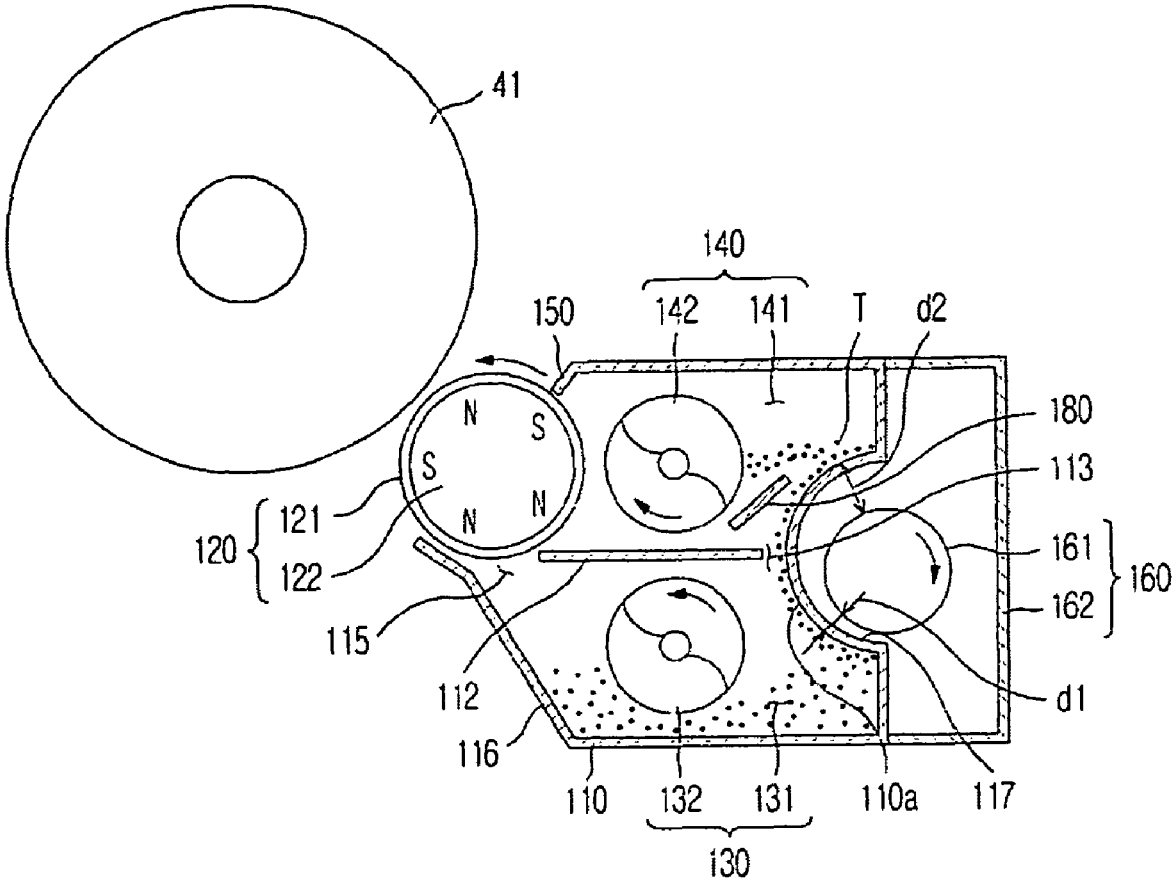
FIG. 6 is a sectional view illustrating a developing device in accordance with a second embodiment of the present invention.

FIG. 6 is a sectional view illustrating a developing device in accordance with a second embodiment of the present invention. The configurations and operations of this embodiment commonly shared with the previously described embodiments will be designated by the same reference numerals, and, for brevity sake, the detailed description thereof will not be repeated.

As shown in FIG. 6, the developing device in accordance with the second embodiment may include a guide 180 to prevent the developer T delivered to the second auger section 140 from being falling back into the first auger section 130 through the first communicating hole 113 when it is separated from the inner surface 110*a* of the casing 110.

Also, in this embodiment, the rotating shaft of the magnet 161 is shifted downward in the seating portion 117 such that the distance between the inner surface 110*a* of the casing 110 corresponding to the seating portion 117 and the magnet 161 increases as moving away from the first auger section 130 toward the second auger section 140.

Accordingly, it may be easier for the developer T in the first auger section 130 to adhere to the inner surface 110*a* of the casing 110 due to the stronger magnetic force, and for the developer T delivered to the second auger section 140 through the first communicating hole 113 to separate from the inner surface 110*a* of the casing 110 being subjected to the weaker magnetic force.

Although the arched seating portion 117 can be configured to have a single curvature as previously described, it is within the contemplation of the present embodiment that the seating portion 117 may alternatively have various other curvatures or inclinations so long as the distance d1 between the inner surface 110*a* corresponding to the first auger section 130 and the magnet 161 is smaller than the distance d2 between the inner surface 110*a* corresponding to the second auger section 140 and the magnet 161.

Figure 7:
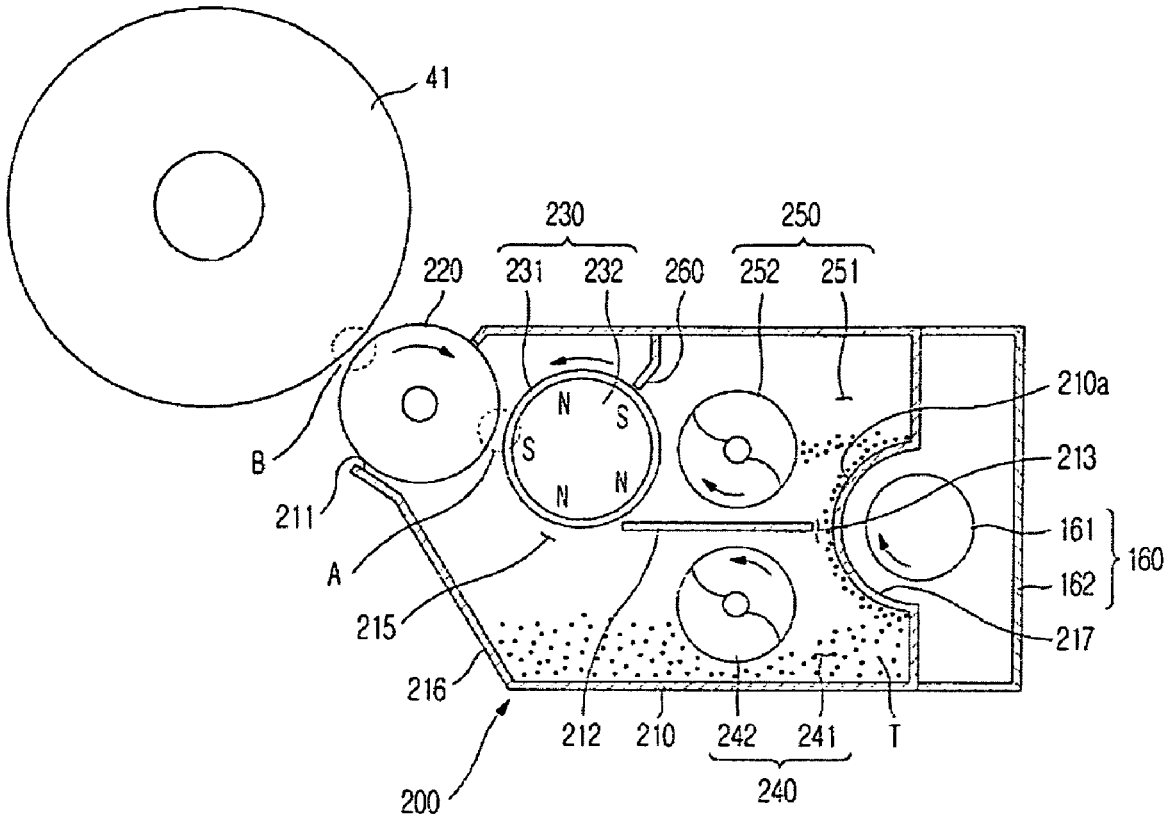
FIG. 7 is a sectional view illustrating a developing device in accordance with a third embodiment of the present invention.

FIG. 7 is a sectional view illustrating a developing device in accordance with a third embodiment of the present invention. Again, the configurations and operations of this embodiment that are commonly shared with the previously described embodiments will be designated by the same reference numerals without repeating the description thereof in detail.

The developing device 200 according to this embodiment may take the form of a hybrid developing device, in which a magnetic brush composed of toner and carrier is formed on the surface of a magnetic roller, and only the toner is supplied from the magnetic brush to a developing roller, and is conveyed to a photosensitive member so as to develop an electrostatic latent image on the photosensitive member.

In particular, as shown in FIG. 7, the developing device 200 may include a casing 210 to receive the developer T therein, and which defines an external appearance of the developing device 200. The casing 210 has an opening 211 extending in a longitudinal direction thereof, and may house therein a developing roller 220, a magnetic roller 230. The developing device 200 may further include first and second auger sections 240 and 250 defined one on top of the other within the casing 210 for agitation and delivery of the developer T, a regulator 260, and the developer delivery unit 160 to deliver the developer T from the first auger section 240 to the second auger section 250.

The casing 210 serves as a developer container receiving the developer T to be supplied to the photosensitive member 41 and the developer T recovered from the photosensitive member 41. The interior of the casing 210 is divided, by a partition 212, into the lower first auger section 240 and the upper second auger section 250.

The first and second auger sections 240 and 250, first to third communicating holes 213 and 215 (the second communicating hole is not shown), and inclined wall 216 of the casing 210 are similar to those of the casing 110 previously described, the descriptions of which are thus not repeated.

The developing roller 220 is arranged so as not to contact with the photosensitive member 41 and the magnetic roller 230. An AC/DC power source (not shown) and a DC power source (not shown) may provide the developing bias to move the toner from the developing roller 220 to the photosensitive member 41, and the supply bias to move the toner from the magnetic roller 230 to the developing roller 220, respectively.

The magnetic roller 230 includes a rotating sleeve 231, and a magnetic core 232 installed in the sleeve 231 to provide a magnetic force required to produce a magnetic brush.

The developer delivery unit 160 may have the same configuration as that of any of the previously described embodiments. For example, the developer delivery unit may be of the same configuration as that of the first embodiment. In particular, the developer delivery unit 160 is provided at a predetermined region on the outside of the casing 210 corresponding to the first communicating hole 213. The developer delivery unit 160 includes the magnet 161 to deliver the developer T, the driver 170 to drive the magnet 161, and the cover 162 to cover the magnet 161.

The magnet 161 may take the form of a roller having a length corresponding to the width of the first communicating hole 213. One side of the magnet 161 is connected to the driver 170 and the other side of the magnet 161 is rotatably coupled to the cover 162.

The casing 210 has an arched seating portion 217 corresponding to the roller-shape of the magnet 161. The outer circumferential surface of the magnet 161 and an outer surface of the seating portion 217 of the casing 210 are spaced apart from each other by a predetermined distance, to apply a magnetic force of the magnet 161 to the developer T in the first auger section 240.

With the above-described configuration, the toner and carrier can be frictionally agitated with each other by rotation of first and second auger screws 242 and 252 causing the toner to be charged.

If the developer T is agitated by the first auger screw 242 and is delivered to the first communicating hole 213 in a first receiving space 241, the developer T adheres to the inner surface 210*a* of the casing 210 adjacent the magnet 161 by the magnetic force of the magnet 161. Then, as the magnet 161 rotates, the developer T moves upward along the inner surface 210*a* of the casing 210, thereby being delivered to the second auger section 250 through the first communicating hole 213.

As the developer T delivered to the second auger section 250 continuously moves upward along the inner surface 210*a* of the casing 210 and away from the magnet 161, the developer T is separated from the inner surface 210 of the casing 210 by its own weigh, thereby being seated in the second receiving space 251 of the second auger section 250.

The developer T in the second auger section 250 reaches the magnetic roller 230 by being agitated by the second auger screw 252.

The regulator 260 uniformly regulates the magnetic brush produced around the magnetic roller 230. The toner is separated from the magnetic brush, by the supply bias applied to the magnetic roller 230, in a supply region A where the developing roller 220 and the magnetic roller 230 oppose each other, thereby being supplied to the developing roller 220, and forming a uniform toner layer on the developing roller 220.

Each charge roller 42 charges the surface of the respective corresponding photosensitive member 41 to a uniform potential, and the exposure device 30 irradiates light corresponding to image information to the photosensitive member 41. Thereby, an electrostatic latent image, which includes an image portion and a non-image portion having different potentials from each other, is formed on the surface of the photosensitive member 41.

While the toner layer formed on the developing roller 220 passes through the developing region B where the photosensitive member 41 and the developing roller 220 oppose each other, the toner is separated from the toner layer on the developing roller 220 by the developing bias and is attached to the image portion of the electrostatic latent image, thereby forming a visible toner image on the photosensitive member 41.

Thereafter, the unused toner collected from the developing roller 220 adheres to the magnetic brush of the magnetic roller 230. By a magnetic force generated from magnetic poles on the magnetic core 232 of the magnetic roller 230, the toner is separated from the magnetic roller 230, thereby being introduced into the first auger section 240 through the third communicating hole 215.

Accordingly, the developer delivery unit of the third embodiment is applicable to the hybrid developing device, and can exhibit the same effects as the first embodiment.

As apparent from the above description, according to the present invention, since a developer delivery unit is provided at the outside of a casing, it is possible to deliver the developer without requiring a seal for the developer delivery unit.

Further, according to an embodiment, the developer delivery unit can be constructed using a uni-polar magnet, making it possible to simplify the magnet arrangement and/or to reduce the manufacturing costs.

Although embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus, comprising:

a photosensitive member having a surface configured to support an electrostatic latent image thereon; and a developing device having a developing roller arranged to supply developer to the photosensitive member to develop the electrostatic latent image into a developer image, wherein the developing device comprises:

a casing defining an external appearance of the developing device;

a first developer receiving chamber provided within the casing, the first developer receiving chamber defining a first volume capable of containing the developer therein;

a second developer receiving chamber provided within the casing, the second developer receiving chamber defining a second volume capable of containing the developer therein;

a partition disposed between the first developer receiving chamber and the second developer receiving chamber to define a recirculation passage beneath the developing roller and a delivery developer passage provided within the casing, the delivery developer passage defining a path through which the developer moves at least from the first developer receiving chamber to the second developer receiving chamber; and a developer delivery unit provided outside of the casing, the developer delivery unit being configured to cause a movement of the developer from the first developer receiving chamber to the second developer receiving chamber.

2. The image forming apparatus according to claim 1, further comprising:

a first agitating member disposed in the first developer receiving chamber, the first agitating member being configured to move the developer contained in the first developer receiving chamber in a first direction toward the delivery developer passage; and a second agitating member disposed in the second developer receiving chamber, the second agitating member being configured to move the developer contained in the second developer receiving chamber in a second direction opposite the first direction.

3. The image forming apparatus according to claim 2, wherein each of the first and second agitating members comprises an auger screw having a plurality of spiral blades rotating about a rotational axis.

4. The image forming apparatus according to claim 1, wherein the developer delivery unit comprises a magnet.

5. The image forming apparatus according to claim 4, wherein the magnet is rotatably supported outside the casing at a location proximate to the delivery developer passage, wherein the image forming apparatus further comprises a driver disposed outside the casing, the driver being configured to deliver a rotational force to the magnet so as to cause the magnet rotate.

6. The image forming apparatus according to claim 4, wherein the magnet comprises a uni-pole magnet.

7. The image forming apparatus according to claim 5, wherein the magnet has a cylindrical roller shape rotating about its longitudinal axis, wherein the casing comprises a seating portion provided proximate to the delivery developer passage, the seating portion having an arched casing wall having a curvature that is convex into the casing, and that substantially correspond to the cylindrical roller shape of the magnet.

8. The image forming apparatus according to claim 7, wherein the magnet is placed in relation to the seating portion such that lengths of radial lines extending from an axial center of the magnet to the arched casing wall are substantially the same.

9. The image forming apparatus according to claim 7, wherein the magnet is placed in relation to the seating portion such that a first length of a first radial line extending from an axial center of the magnet to a first portion of the arched casing wall proximate to the first developer receiving chamber is shorter than a second length of a second radial line extending from the axial center of the magnet to a second portion of the arched casing wall proximate to the second developer receiving chamber.

10. The image forming apparatus according to claim 2, wherein the delivery developer passage comprises:

a first communicating hole provided at a first longitudinal end of the casing proximate to the developer delivery unit, wherein the first agitating member moves the developer in the first direction toward the first communicating hole, the developer being moved from the first developer receiving chamber to the second developer receiving chamber through the first communicating hole;

a second communicating hole provided at a second longitudinal end of the casing opposite the first longitudinal end, wherein the second agitating member moves the developer in the second direction toward the second communicating hole and away from the first communicating hole, the second developer receiving chamber being disposed above the first developer receiving chamber such that the developer moves from the second developer receiving chamber to the first developer receiving chamber through the second communicating hole by gravitational force; and a third communicating hole extending along a longitudinal direction of the casing, wherein the developing roller is disposed to extend parallel to the third communicating hole to receive the developer from the second developer receiving chamber, the developer moving from the developing roller to the first developer receiving chamber through the third communicating hole.

11. The image forming apparatus according to claim 10, further comprising:

a guide member disposed in the second developer receiving chamber between the second agitating member and the delivery developer passage, the guide member being configured to interfere with movement of the developer from the second developer receiving chamber to the first developer receiving chamber through the first communicating hole.

12. The apparatus according to claim 1, wherein the developer is a binary developer comprising toner particles and magnetic carrier particles, the image forming apparatus further comprising:

a magnetic roller disposed to oppose the developing roller on a first side of the developing roller opposite a second side of the developing roller that opposes the photosensitive member, the magnetic roller being configured to receive the binary developer from the second developer receiving chamber, and to form on an outer circumferential surface thereof a magnetic brush comprising the toner particles and the magnetic carrier particles, the toner particles of which magnetic brush being transferred to the developing roller to form a layer of toner on the developing roller, the developing roller being configured to supply the toner particles to the photosensitive member to develop the electrostatic latent image.

13. The image forming apparatus of claim 1, wherein the developing device further comprises a recirculation wall extending from the second chamber toward a second side of the developing roller opposite a first side of the developing roller and disposed beneath the recirculation passage to receive toner conveyed through the recirculation passage and to direct the toner back into the second developer receiving chamber.

14. A developing device used in an image forming apparatus including a photosensitive member having a surface configured to support an electrostatic latent image thereon, the developing device comprising:

a developing roller arranged to supply developer to the photosensitive member to develop the electrostatic latent image into a developer image, wherein the developing device comprises:

a casing defining an external appearance of the developing device;

a first developer receiving chamber provided within the casing, the first developer receiving chamber defining a first volume capable of containing the developer therein;

a second developer receiving chamber provided within the casing, the second developer receiving chamber defining a second volume capable of containing the developer therein;

a partition disposed between the first developer receiving chamber and the second developer receiving chamber to define a recirculation passage beneath the developing roller and a delivery developer passage provided within the casing, the delivery developer passage defining a path through which the developer moves at least from the first developer receiving chamber to the second developer receiving chamber; and a developer delivery unit provided outside of the casing, the developer delivery unit being configured to cause a movement of the developer from the first developer receiving chamber to the second developer receiving chamber.

15. A developing device according to claim 14, further comprising:

a first agitating member disposed in the first developer receiving chamber, the first agitating member being configured to move the developer contained in the first developer receiving chamber in a first direction toward the delivery developer passage; and a second agitating member disposed in the second developer receiving chamber, the second agitating member being configured to move the developer contained in the second developer receiving chamber in a second direction opposite the first direction.

16. The developing device according to claim 14, wherein the developer delivery unit comprises a magnet rotatably supported outside the casing at a location proximate to the delivery developer passage.

17. The developing device according to claim 16, wherein the magnet comprises a uni-pole magnet.

18. The developing device according to claim 16, wherein the magnet has a cylindrical roller shape rotating about its longitudinal axis, wherein the casing comprises a seating portion provided proximate to the delivery developer passage, the seating portion having an arched casing wall having a curvature that is convex into the casing, and that substantially correspond to the cylindrical roller shape of the magnet.

19. The developing device according to claim 18, wherein the magnet is placed in relation to the seating portion such that lengths of radial lines extending from an axial center of the magnet to the arched casing wall are substantially the same.

20. The developing device according to claim 18, wherein the magnet is placed in relation to the seating portion such that a first length of a first radial line extending from an axial center of the magnet to a first portion of the arched casing wall proximate to the first developer receiving chamber is shorter than a second length of a second radial line extending from the axial center of the magnet to a second portion of the arched casing wall proximate to the second developer receiving chamber.

21. The developing device according to claim 15, wherein the delivery developer passage comprises:

a first communicating hole provided at a first longitudinal end of the casing proximate to the developer delivery unit, wherein the first agitating member moves the developer in the first direction toward the first communicating hole, the developer being moved from the first developer receiving chamber to the second developer receiving chamber through the first communicating hole;

a second communicating hole provided at a second longitudinal end of the casing opposite the first longitudinal end, wherein the second agitating member moves the developer in the second direction toward the second communicating hole and away from the first communicating hole, the second developer receiving chamber being disposed above the first developer receiving chamber such that the developer moves from the second developer receiving chamber to the first developer receiving chamber through the second communicating hole by gravitational force; and a third communicating hole extending along a longitudinal direction of the casing, wherein the developing device further comprises a developing roller disposed to extend parallel to the third communicating hole to receive the developer from the second developer receiving chamber, the developer moving from the developing roller to the first developer receiving chamber through the third communicating hole.

22. The developing device according to claim 21, further comprising:

a guide member disposed in the second developer receiving chamber between the second agitating member and the delivery developer passage, the guide member being configured to interfere with movement of the developer from the second developer receiving chamber to the first developer receiving chamber through the first communicating hole.

23. The developing device according to claim 21, wherein the developer is a binary developer comprising toner particles and magnetic carrier particles, the developing device further comprising:

a magnetic roller disposed to oppose the developing roller, the magnetic roller being configured to receive the binary developer from the second developer receiving chamber, and to form on an outer circumferential surface thereof a magnetic brush comprising the toner particles and the magnetic carrier particles, the toner particles of which magnetic brush being transferred to the developing roller to form a layer of toner on the developing roller.

24. The developing delivery device of claim 14, further comprising a recirculation wall extending from the second chamber toward a second side of the developing roller opposite a first side of the developing roller and disposed beneath the recirculation passage to receive toner conveyed through the recirculation passage and to direct the toner back into the second developer receiving chamber.

25. A developing device including a developing roller to rotate about a developing axis to supply developer to a photosensitive member, comprising:

a casing including a base and a top;

a partition disposed in the casing to define a first developer chamber between the partition and the base of the casing to support developer and to define a delivery developer passage between the partition and the casing and to define a second developer chamber between partition and the top of the casing to receive developer from the first developer chamber via the delivery developer passage;

a developer delivery unit provided outside of the casing to rotate about a delivery axis parallel to the developing axis to magnetically transport the developer from the first developer receiving chamber to the second developer receiving chamber via the delivery developer passage; and a developer guide disposed inside the casing above the partition and the delivery passage and adjacent the developer delivery unit to direct toner transferred by the delivery unit away from the delivery passage and into the second developer chamber.

26. The developing device of claim 25, wherein the guide is inclined and slopes toward the partition.

27. The developing device of claim 25, further comprising a recirculation wall extending from the base toward a second side of the developing roller opposite a first side of the developing roller to define a recirculation passage between the recirculation wall and the partition and to direct developer conveyed through the recirculation passage back to the first developer chamber.

28. The developing device of claim 27, further comprising a lip extending from the recirculation wall and disposed beneath the developing roller to direct developer from the developing roller to the recirculation wall.

* * * * *